United States Patent [19]

Sze et al.

[11] 4,028,221

[45] June 7, 1977

[54] LIQUEFACTION OF SUB-BITUMINOUS AND LIGNITIC COAL

[75] Inventors: Morgan C. Sze, Upper Montclair; George J. Snell, Fords, both of N.J.

[73] Assignee: The Lummus Company, Bloomfield, N.J.

[22] Filed: June 6, 1975

[21] Appl. No.: 584,627

[52] U.S. Cl. ..... 208/8; 208/10

[51] Int. Cl.[2] ..... C10G 1/06

[58] Field of Search ..... 208/8, 10

[56] References Cited

UNITED STATES PATENTS

| | | | |
|---|---|---|---|
| 2,106,973 | 2/1938 | Ellis | 208/8 |
| 3,540,995 | 11/1970 | Wolk et al. | 208/10 |
| 3,607,719 | 9/1971 | Johnson et al. | 208/10 |

*Primary Examiner*—Delbert E. Gantz
*Assistant Examiner*—James W. Hellwege
*Attorney, Agent, or Firm*—Marn & Jangarathis

[57] ABSTRACT

In the liquefaction of a sub-bituminous and/or lignitic coal, prior to the liquefaction, the coal is soaked at a temperature of from 550° to 750° F and a pressure of from 30 to 300 psig for a time sufficient to remove at least 10% of the organic oxygen present in the coal to thereby reduce the hydrogen requirements of the liquefaction. The liquefaction is effected with a pasting solvent derived from the sub-bituminous and/or lignitic coal having a 5 volume percent distillation temperature of at least 550° F and containing at least 25 weight percent of material boiling above 800° F. The use of such a pasting solvent provides for improved dispersion of the coal particles during the liquefaction.

12 Claims, 1 Drawing Figure

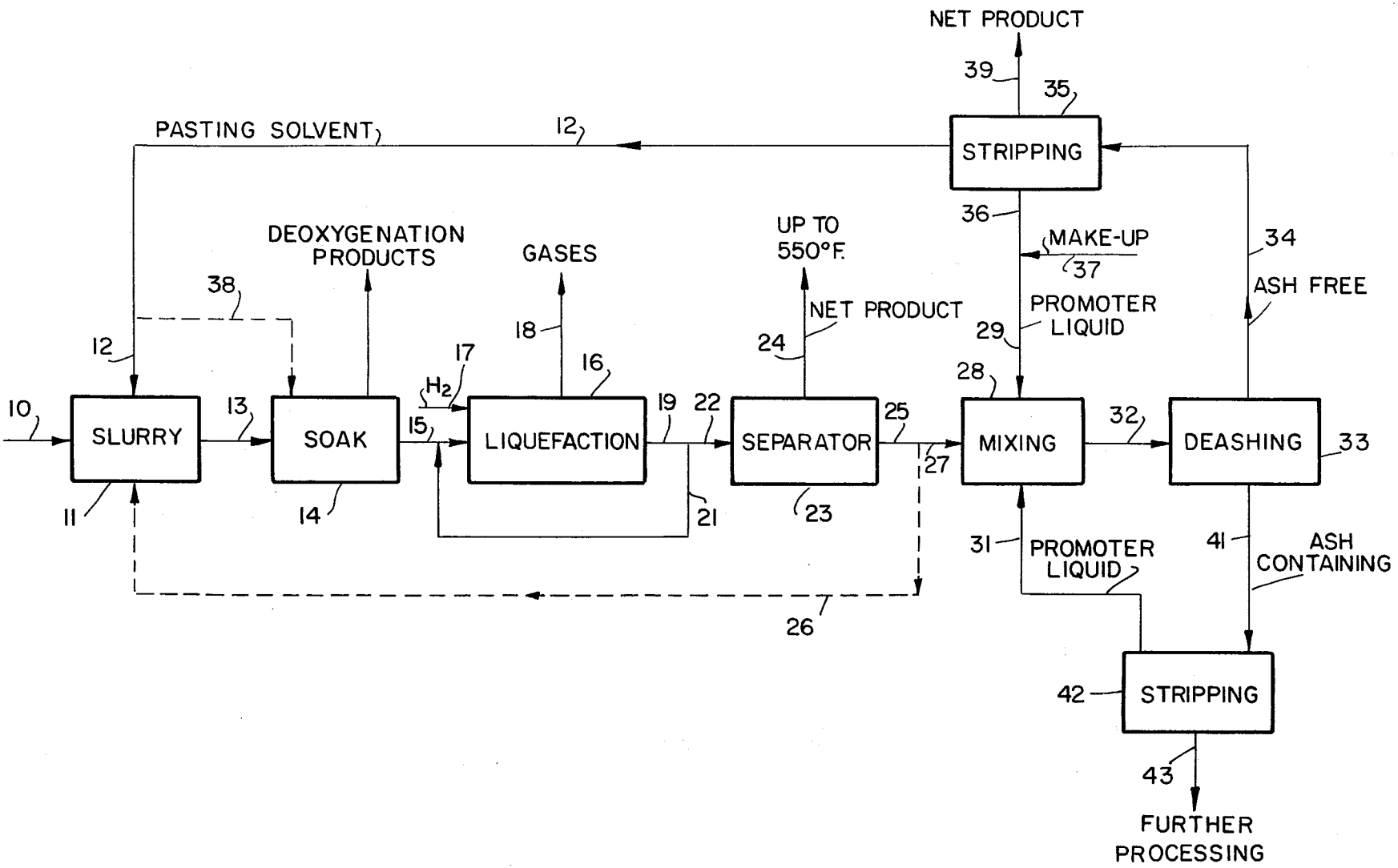
SLURRY
SOAK
LIQUEFACTION
SEPARATOR
MIXING
DEASHING
STRIPPING
STRIPPING
PASTING SOLVENT
DEOXYGENATION PRODUCTS
GASES
$H_2$
UP TO 550°F.
NET PRODUCT
NET PRODUCT
MAKE-UP
PROMOTER LIQUID
PROMOTER LIQUID
ASH FREE
ASH CONTAINING
FURTHER PROCESSING
10
11
12
12
13
14
15
16
17
18
19
21
22
23
24
25
26
27
28
29
31
32
33
34
35
36
37
38
39
41
42
43

LIQUEFACTION OF SUB-BITUMINOUS AND LIGNITIC COAL

This invention relates to the liquefaction of coal, and more particularly, to a new and improved process for effecting the liquefaction of a sub-bituminous and/or lignitic coal.

Coal can be converted to valuable products by subjecting coal to solvent extraction to produce a mixture of coal extract and undissolved coal residues. In general, the hydroliquefaction of coal is effected with a pasting solvent, derived from the coal liquefaction process, with such a pasting solvent generally having a boiling range in the order of from about 600° F to about 900° F. The pasting solvent and coal are then hydrogenated in the presence of a coal liquefaction catalyst. The processes which are generally disclosed in the art have been specifically designed for the liquefaction of bituminous coals. In attempting to apply such known technology to coals of lower rank; i.e., sub-bituminous and/or lignitic coals, we have found that there is a need for improvements in such known technology in order to provide an effective process for the hydroliquefaction of the sub-bituminous and/or lignitic coals.

The principal object of the present invention is to provide a new and improved process for effecting liquefaction of sub-bituminous and/or lignitic coal.

In accordance with one aspect of the present invention, there is provided an improved process for the hydroliquefaction of sub-bituminous and/or lignitic coal wherein prior to the hydroliquefaction step, the coal is soaked in order to remove at least a portion of the organic oxygen content thereof.

In accordance with another aspect of the present invention, there is provided an improved process for the hydroliquefaction of a sub-bituminous and/or lignitic coal wherein the hydroliquefaction is effected in a pasting solvent produced from the hydroliquefaction of sub-bituminous and/or lignitic coal, with the present solvent containing at least 25 weight percent of material boiling above 800° F.

As known in the art, sub-bituminous coals, include those coals having an A.S.T.M. classification of III; and lignitic coals include those coals having an A.S.T.M. rank of IV; in particular, brown coal and lignite.

More particularly, the coal which is to be subjected to a hydroliquefaction process is partially deoxygenated or decarboxylated by heat soaking, with elimination of carbon dioxide, water and smaller amounts of carbon monoxide as the principal products. Smaller amounts of organic oxygenated compounds, and still smaller amounts of light hydrocarbon gases ($C_1$ to $C_4$), may also be formed. The soaking of the coal, prior to hydroliquefaction, is effected at conditions such that at least 10% of the organic oxygen contained in the coal is removed, with the organic oxygen content of the coal generally being removed in an amount of from about 15% to about 60% or higher. The heat soaking is generally effected at a temperature of at least 500° F, generally in the order of about 550° F to about 750° F and at a pressure of less than about 300 psig, generally in the order of from about 30 to about 300 psig. The heat soaking is effected for a time sufficient to provide the desired oxygen removal, with such times generally being in the order of from about 0.05 to 2 hours.

The soaking, prior to hydroliquefaction, is generally effected with the coal dispersed in the pasting solvent to be used in the subsequent hydroliquefaction, although it is possible to effect such deoxygenation of the coal in the solid phase, although such an operation is less preferred. It is also to be understood that although in one aspect of the present invention, the hydroliquefaction is effected in a particular type of pasting solvent, deoxygenation of the sub-bituminous and/or lignitic coal may be effected in pasting solvents other than the type preferably employed in the subsequent hydroliquefaction step.

The pre-soaking of the sub-bituminous and/or lignitic coal to effect deoxygenation thereof minimizes the net hydrogen requirements for the hydroliquefaction. It has been found that sub-bituminous and/or lignitic coals generally have no oxygen content in the order of from about 15% to about 30% on an maf basis, in comparison to bituminous coals which generally have an oxygen content of from about 4 to about 12 weight percent on an maf basis. Accordingly, by deoxygenating the sub-bituminous and/or lignitic coal by the procedure of the present invention, the hydrogen requirements for the subsequent hydroliquefaction are significantly reduced.

In accordance with the further aspect of the present invention, the hydroliquefaction of the sub-bituminous and/or lignitic coal is effected with an indigenous pasting solvent; i.e., a pasting solvent derived from the sub-bituminous and/or lignitic coals, with the pasting solvent containing at least 25%, by weight, or components boiling above 800° F, and preferably from about 35% to about 70%, by weight, of components boiling above 800° F. The pasting solvent generally has a 5 volume percent distillation temperature of at least about 550° F, although lower boiling components may also be included in the pasting solvent; that is, the pasting solvent can include components boiling below 550° F, provided that the pasting solvent includes at least 25 weight percent of components boiling above 800° F. It is to be understood that the hereinabove described temperatures are all corrected to 1 atmosphere. It has been found that the use of an indigenous pasting solvent having components boiling above 800° F in an amount of at least 25 weight percent for the hydroliquefaction of sub-bituminous and/or lignitic coal maintains the coal in a dispersed state, whereas the use of an indigenous pasting solvent not having such heavier components results in the coal becoming undispersed, whereby the coal accumulates in the reactor and increases the pressure drop through the reactor.

The hydroliquefaction of the sub-bituminous and/or lignitic coal is generally effected at a temperature of from about 600° F to about 900° F, preferably from about 650° F to about 850° F, and at a pressure from about 500 psig to about 4000 psig. Typical liquid hourly space velocities are in the order from about 0.3 to about 4.0 hours$^{-1}$.

The hydroliquefaction is generally effected in the presence of a suitable hydroliquefaction catalyst, which is generally either a group 6B and/or group 8 metal oxide and/or sulfide, supported on a suitable support, such as alumina or silica-alumina. The preferred catalysts are cobalt-molybdate, nickel-molybdate and nickel tungsten sulfide. The catalyst may be in the physical form of extrudates, tablets, spheres or randomly shaped particles and may assume any particle size, with a particle size in the range of 4 to 40 mesh being preferred. The contacting may be effected by any one of the wide variety of procedures known in the art, including catalyst added as a powder, a fixed catalyst bed, a fluidized catalyst bed, an ebullating bed and the like. A preferred mode is an upflow expanded bed. The hydroliquefaction may be effected in one or more reactors, with the preferred reactor arrangement being two or three reactors connected in series.

The present invention will be further described with respect to an embodiment thereof illustrated in the accompanying drawings, wherein:

The drawing is a simplified schematic flow diagram of an embodiment of the present invention.

It is to be understood, however, that the scope of the present invention is not to be limited to the illustrated embodiment.

Referring now to the drawing, a ground, partially dried (3–15% moisture) sub-bituminous and/or lignitic coal, such as brown coal, in line 10 is introduced into a coal slurrying zone 11, wherein the coal is slurried in a pasting solvent introduced through line 12. The pasting solvent is of the type hereinabove described; i.e., an indigenous pasting solvent containing at least 25 weight percent of components boiling above 800° F. The slurrying of the coal in the pasting solvent is generally effected at a temperature in the order of about 150° F to about 450° F and at a pressure in the order of from about 0 to about 50 psig to provide a coal suspension in the pasting solvent containing from about 25 to about 45 weight percent of the coal. In the slurrying operation, some water vapor may be liberated, and such water vapor is conveniently vented from the slurrying zone.

The suspension or dispersion of coal in the pasting solvent is withdrawn from slurrying zone 11 through line 13 and introduced into a soaking zone 14, wherein the coal slurry is heat soaked, as hereinabove described, to effect deoxygenation of the coal, with the deoxygenation products being vented from the soaking zone. The soaking zone is operated at conditions hereinabove described to effect at least 10% removal, generally in the order of from about 15 to about 60% removal, of the organic oxygen compounds present in the coal.

A partially deoxygenated coal paste is withdrawn from soaking zone 14 through line 15 and introduced into a liquefaction zone 16 along with hydrogen containing gas in line 17. It is to be understood that the hydrogen containing gas and coal paste may be premixed prior to introduction into the liquefaction zone 16. The liquefaction zone contains a catalyst, as hereinabove described, and is operated at conditions hereinabove described to effect liquefaction of the sub-bituminous and/or lignitic coal. As hereinabove described, the liquefaction zone is preferably an upflow expanded bed reactor containing two to three reactors in series. It is to be understood, however, that other forms of reactors may be employed in the liquefaction zone.

Gaseous products are vented from the liquefaction zone through line 18 and a coal liquefaction product is withdrawn through line 19. In some cases, a portion of the liquefaction product is recycled through line 21, although in most cases, no recycle is required.

The net liquefaction product in line 22 is introduced into a distillation zone 23 to separate lighter components therefrom. In general, the zone 23 is operated to effect distillation of materials boiling up to about the final boiling point of a deashing promotor liquid which is employed in the subsequent deashing step. In general, components more volatile than about 550° to about 600° F are removed in separation zone 23 through line 24, with such products forming a portion of the net coal liquefaction product.

A residual product is withdrawn from zone 23 through line 25 and a portion thereof may be optionally recycled to the slurry zone 11 and/or the soaking zone 14. In general, the recycle through line 26, if any, is not effected when the product contains more than about 15 weight percent of total solids.

The remaining product in line 27 is introduced into a mixing zone 28 wherein the product is admixed with a deashing promoter liquid introduced through line 29.

The deashing promotor liquid is of the type and is employed as described in U.S. Pat. No. 3,856,675, granted on Dec. 24, 1974, which is hereby incorporated by reference. As described in the aforesaid patent, the promotor liquid has a characterization factor (K) of at least about 9.75, and preferably at least about 11.0. The promoter liquid which is employed to enhance and promote the separation of insoluble material from the coal liquefaction product is further characterized by a 5 volume percent distillation temperature of at least about 250° F and a 95 volume percent distillation temperature of at least about 350° F and no greater than about 750° F, with the promoter liquid preferably having a 5 volume percent distillation temperature of at least about 310° F and most preferably of at least about 400° F. The 95 volume percent distillation temperature is preferably no greater than about 600° F. The most preferred promoter liquid has a 5 volume percent distillation temperature of at least about 425° F and a 95 volume percent distillation temperature of no greater than about 500° F. The promoter liquid is preferably employed in an amount to provide a promoter liquid to coal liquefaction product weight ratio of from about 0.5 to about 1.0.

The mixture of coal liquefaction product and promoter liquid, withdrawn from mixing zone 28 through line 32, is introduced into a deashing zone 33, wherein an essentially ash free product, is separated from a product containing the coal ash. As described in the aforesaid U.S. patent, the deashing zone 33 preferably contains one or more gravity settlers, with the gravity settling preferably being effected at a temperature from about 400° F to about 600° F.

An overflow product, essentially free of insoluble material, is withdrawn from deashing zone 33 through line 34 and introduced into a stripping zone 35 to effect recovery of the promotor liquid therefrom. The promoter liquid is withdrawn from stripping zone 35 through line 36, combined with make-up promoter liquid in line 37, as required, and introduced into the mixing zone 28 through line 29.

The remainder of the overflow product is divided into two streams, with one of the streams being employed in line 12 as the pasting solvent for the liquefaction process. A portion of the pasting solvent, if desired, may be introduced into the soaking zone 14 through line 38. The remainder of the product; i.e., the portion not employed as pasting solvent, is recovered, as net product, through line 39.

An ash enriched underflow is withdrawn from deashing zone 33 through line 41 and introduced into a stripping zone 42 to effect recovery of any promoter liquid therefrom. The promoter liquid is withdrawn from the stripping zone 42 through line 31 and recycled to the mixing zone 28.

The remaining ash enriched product is withdrawn from stripping zone 42 through line 43 for further processing. Thus, for example, the ash enriched stream in line 43 may be subjected to coking and/or gasification.

The hereinabove described embodiment may be modified within the spirit and scope of the present invention and, accordingly, the present invention is not limited to such an embodiment. Thus, for example, although the coal liquefaction product is preferably deashed, as described, deashing may be effected by other procedures.

As a further modification, although the overall process preferably combines the deoxygenation and liquefaction aspects of the present invention, it is to be understood, that in some cases, an overall process could be provided wherein liquefaction could be effected without the use of an indigenous pasting solvent, whereby the pasting solvent for liquefaction of the sub-bituminous and/or lignitic coal need not include heavier components, as herein described.

These and other modifications of the present invention should be apparent to those skilled in the art from the teachings herein.

The invention will be further described with respect to the following examples; however, it is to be understood that the scope of the invention is not to be limited thereby.

EXAMPLE 1

A coal slurry consisting of 429 gms. of brown coal, whose analysis is compiled in Table 1, and 1000 gms. of +550° F hydrotreated lignite tar are slurried in a 2-liter beaker at 200° F. The admixture thus prepared is charged to a nitrogen purged 2-liter electrically heated bomb, outfitted with a back pressure regulator. The bomb is closed up, a back pressure of about 150 psig is set on the regulator and about 2 SCFH of hydrogen gas is fed to the vapor space of the bomb. Off gas from the bomb is cooled and led into a water cooled separator. Non-condensible gas from the separator is fed to an integrating flow meter and collected in a rubber gas bag. The liquid contents of the bomb after closure are heated to 600° F over about a 15 minute period and held for about 20 minutes at 600° F. At the end of this hold period the integrating flow meter is read and the gas bag is disconnected and sealed. A.G.C. analysis is done on the composite off gas contained in the gas bag. The total amount of carbon dioxide ($CO_2$) liberated with the off gas is calculated from the former GC analysis and the total molar amount of off gas determined via the integrating flow meter. About 26% of the organic oxygen present in the coal charge was liberated as carbon dioxide ($CO_2$) in this experiment.

EXAMPLE 2

Example 1 is repeated with a 2-liter bomb charge consisting of 0 gm. of brown coal and 1000 gms. of the +550° F hydrotreated lignite tar used in Example 1. Essentially no carbon dioxide was found in the composite off gas collected during this run.

EXAMPLE 3

A coal paste containing 30 wt. % brown coal (see Table 1 for inspection data) and 70 wt. % paste solvent I (see Table 2 for inspection data) is prepared at 190° F in a steam jacked, agitated feed tank. The former paste solvent is derived from hydrotreated brown coal tar to simulate an indigenous solvent. This coal paste is fed to a heater coil via a proportioning pump where it is mixed with a hydrogen rich gas under pressure. The temperature of coal paste-hydrogen rich gas mixture is increased to about 550° F in the heater. This mixture in turn is continuously fed to a catalytic upflow hydroliquefaction reactor. Reactor operating conditions are compiled below in Table 3.

Effluent product from the reactor is collected in a hot water jacketed high pressure separator/receiver vessel, in which a gas and liquid phase are separated from each other. Gas is continuously vented from the high pressure separator/receiver through a pressure control valve. When the liquid contents of the high pressure separator/receiver occupy about 75–80% of the available volume of the high pressure separator/receiver vessel, the reactor effluent product is diverted to a second identical high pressure separator/receiver vessel which has been pre-pressured via a hydrogen rich gas to the operating pressure. The contents of the first high pressure separator/receiver are then dropped to a steam jacketed low pressure liquid product receiver operating at substantially atmospheric pressure. Liquid product from the low pressure product is transferred to a steam jacketed, agitated storage tank. The above sequence of operations are repeated and continuous reactor operations are thereby achieved.

The continuous brown coal run described in this example was voluntarily terminated after about 48 hours of operation. A representative composite sample of liquid product solution was withdrawn from the agitated storage tank and the volumetric amount of product solution was determined along with the storage tank temperature. An ash content (ASTM D-482), quinoline insolubles content (ASTM D-2318) and specific gravity (ASTM D-287) at several temperatures was determined on the above representative liquid product solution. From the former analysis and the weight of composite liquid product solution, it was found that about 83±1% of the maf coal fed to the hydroliquefaction reactor was converted into a quinoline soluble form, which can be used as a measure of the extent of liquefaction. A reactor pressure drop in the range of 20–25 psi was observed throughout the entire 48 hour operating period.

EXAMPLE 4

An attempt is made in this example to repeat Example 3 with a somewhat lighter paste solvent, coded II, whose inspection data is compiled in Table 4. This paste solvent is also derived from hydrotreated brown coal tar to simulate an indigenous pasting solvent. All process conditions on the subject example were essentially identical to those used in Example 3 with the exception of the paste solvent used. Table 3 is a compilation of the hydroliquefaction process conditions used in this example (Example 4).

About 15 minutes after the start of the coal paste feed, the reactor pressure drop increased rapidly from a rather normal 20–25 psi to about 300 psi. A bituminous coal derived heavy creosote oil stored in a standby feed tank was then fed to the unit and the coal paste feed was discontinued. The hydroliquefaction reactor was flushed until such time that the reactor pressure drop was restored to a 20–25 psi value. The creosote oil flush was then interrupted and the reactor was once again fed with the coal paste used previously. About 15 minutes after the second introduction of coal paste, the reactor pressure drop climbed rapidly to a value in excess of 300 psi. The coal hydroliquefaction unit was shut down at this point. After depressurization, cooling, and $N_2$ purging the bottom closure of reactor was opened up and the lower portion of the catalyst bed was visually examined. Regions containing numerous accumulated brown coal particles were evident. The coal particles appeared to have become literally undispersed from the paste solvent in the lower portion of the catalyst bed, which greatly reduced bed permeability.

TABLE 1

| ANALYTICAL INSPECTION DATA SUMMARY FOR GROUND, DRIED BROWN COAL | |
|---|---|
| Proximate Analysis | |
| Moisture, wt. % | 6.02 |
| Volatile Matter (DB), wt. % | 51.48 |
| Ash (DB), wt. % | 0.86 |
| Fixed Carbon (DB), wt. % | 47.66 |
| Ultimate Analysis (as is basis) | |
| Water, wt. % | 6.02 |
| Ash, wt. % | 0.81 |
| Carbon Content, wt. % | 63.07 |
| Hydrogen Content, wt. % (Hyd. in water deducted) | 3.96 |
| Nitrogen Content, wt. % | 0.51 |
| Sulfur Content, wt. % | 0.24 |
| Organic Oxygen Content, wt. % (Via difference) | 25.39 |
| Heating Value (dry basis) | |
| Higher Heating Value (d.b.), btu/lb. | 10,980 |

TABLE 2

| INSPECTION DATA SUMMARY ON THE PASTE SOLVENT (I) USED IN EXAMPLE 3 | |
|---|---|
| Specific Gravity 138/60° F | 1.0269 |
| Specific Gravity 227/60° F | 1.0224 |
| Ash Content, wt. % | 0.17 |
| Sulfur Content, wt. % | 0.44 |
| Carbon Content, wt. % | 85.86 |
| Hydrogen Content, wt. % | 9.35 |
| Nitrogen Content, wt. % | 0.49 |
| Benzene Insolubles, wt. % | 1.5 |

VACUUM DISTILLATION ANALYSIS

| Vol. % Distilled | Wt. % Distilled | Ovhd. Vapor Temp. Corr. to 760mm Hg. Absolute Pressure, ° F |
|---|---|---|
| 0.0 | 0.0 | 429 |
| 1.0 | — | 513 |
| 3.6 | 3.29 | 550 |
| 9.0 | 8.22 | 600 |
| 11.3 | 10.41 | 619 |
| 21.3 | 20.07 | 668 |
| 28.3 | 26.76 | 700 |
| 35.0 | 34.47 | 722 |
| 45.0 | 44.05 | 756 |
| 55.0 | 53.40 | 785 |
| 58.6 | 56.65 | 800 |

TABLE 3

| CATALYTIC HYDROLIQUEFACTION PROCESS PARAMETERS USED IN EXAMPLES 3 AND 4 | |
|---|---|
| Catalyst | Fresh Cobalt Molybdate on Alumina Support |
| Catalyst Form | 8 – 10 mesh spheres |
| Coal Content of Feed, wt.% | 30.0 |
| Paste Solvent Employed | See Examples 3 and 4 |
| Type of Contacting | Upflow expanded bed reactor |
| Liquid Hourly Space Velocity, $Hr^{-1}$ (vol. feed/hr/vol. of catalyst) | 1.7 |
| Operating Pressure, psig | 1400 |
| Reactor Feed Gas Rate, lb mol/gal. liquid feed | 0.1 |
| Hydrogen Content of Feed Gas, mol % | 90 |
| Reactor Inlet Temp., ° F | 550–600 |
| Reactor Outlet Temp., ° F | 780–790 |

TABLE 4

| INSPECTION DATA SUMMARY ON THE PASTE SOLVENT (II) USED IN EXAMPLE 4 | |
|---|---|
| Specific Gravity 225/60 | 0.9951 |
| Specific Gravity 120/60 | 1.007 |
| Ash Content, wt. % | <.01 |
| Sulfur Content, wt. % | 0.37 |
| Carbon Content, wt. % | 86.24 |
| Hydrogen Content, wt. % | 9.65 |
| Nitrogen Content, wt. % | 0.48 |

VACUUM DISTILLATION ANALYSIS

| Vol. % Distilled | Wt. % Distilled | Ovhd. Vapor Temp. Corr. to 760mm Hg. Absolute Pressure, ° F |
|---|---|---|
| 0 | 0 | 453 |
| 3.4 | 2.80 | 490 |
| 9.3 | 8.75 | 550 |
| 19.2 | 18.11 | 600 |
| 31.4 | 29.98 | 669 |
| 45.7 | 44.12 | 700 |
| 56.4 | 54.48 | 759 |
| 66.4 | 64.15 | 769 |
| 76.4 | 73.78 | 783 |
| 82.6 | 79.38 | 800 |

The present invention is particularly advantageous in that sub-bituminous and/or lignitic coal can be liquefied without the use of increased amounts of hydrogen by effecting partial deoxygenation of the coal, as described. Moreover, by proceeding in accordance with the teachings of the present invention, it is possible to employ an indigenous coal pasting solvent, while maintaining the coal readily dispersed in the pasting solvent.

These and other advantages of the present invention should be apparent to those skilled in the art from the teachings herein.

Numerous modifications and variations of the present invention are possible in light of the above teachings, and, therefore, within the scope of the appended claims, the invention may be practiced otherwise than as particularly described.

What is claimed is:

1. In a process for the hydroliquefaction of a coal selected from the group consisting of sub-bituminous and lignitic coals, the improvement comprising:

employing as a pasting solvent for said hydroliquefaction, a liquid fraction produced by the hydroliquefaction of said coal, said liquid fraction containing at least 25 weight percent of components boiling above 800° F.

2. The process of claim 1 wherein the pasting solvent has a 5 volume percent distillation temperature of at least about 550° F.

3. The process of claim 2 wherein the pasting solvent has from about 35% to about 70%, by weight, of components boiling above 800° F.

4. The process of claim 3 wherein the hydroliquefaction is effected at a temperature of from about 600° F to about 900° F and at a pressure of from about 500 to about 4000 psig.

5. The process of claim 4 wherein said coal is a brown coal.

6. The process of claim 1 wherein said coal is heat soaked at a temperature of at least about 500° F and a pressure of no greater than about 300 psig for a time sufficient to remove at least 10% of the organic oxygen present in the coal, said heat soaking being effected prior to said hydroliquefaction.

7. The process of claim 6 wherein said coal is heat soaked in said pasting solvent.

8. The process of claim 7 wherein the heat soaking is effected at a temperature of from about 550° F to 750° F.

9. The process of claim 8 wherein the heat soaking is effected to remove from about 15% to about 60% of the organic oxygen present in the coal.

10. The process of claim 9 wherein said coal is a brown coal.

11. The process of claim 7 wherein the pasting solvent has a 5 volume percent distillation temperature of at least about 550° F and from about 35% to about 70%, by weight, of the components thereof boiling above 800° F.

12. The process of claim 11 wherein the hydroliquefaction is effected at a temperature of from about 600° F to about 900° F and at a pressure of from about 500 to about 4000 psig.

* * * * *